US009103578B2

(12) United States Patent
Kuehl

(10) Patent No.: US 9,103,578 B2
(45) Date of Patent: Aug. 11, 2015

(54) SUBSTANCE COMMUNICATING DEVICE FOR COUPLING TO A HOST

(75) Inventor: Steven J. Kuehl, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1568 days.

(21) Appl. No.: 12/643,350

(22) Filed: Dec. 21, 2009

(65) Prior Publication Data

US 2011/0147417 A1 Jun. 23, 2011

(51) Int. Cl.
*F25D 23/12* (2006.01)
*F25D 29/00* (2006.01)

(52) U.S. Cl.
CPC ..... *F25D 29/00* (2013.01); *F25D 2400/361* (2013.01)

(58) Field of Classification Search
CPC ..... F25D 29/00; F25D 29/001; F25D 29/005
USPC ..... 62/331, 332, 337
See application file for complete search history.

(56) References Cited

U.S. PATENT DOCUMENTS

| | | | | |
|---|---|---|---|---|
| 1,958,206 | A | | 5/1934 | Rubsam |
| 3,101,984 | A | | 8/1963 | Wieckmann |
| 3,258,553 | A | | 6/1966 | Breslin |
| 3,561,506 | A | | 2/1971 | Johnson |
| 3,710,060 | A | | 1/1973 | Brevick |
| 4,068,179 | A | | 1/1978 | Sample et al. |
| 4,148,536 | A | | 4/1979 | Petropoulsos et al. |
| 4,317,969 | A | | 3/1982 | Riegler et al. |
| 4,445,743 | A | | 5/1984 | Bakker |
| 4,591,732 | A | | 5/1986 | Neuenschwander |
| 4,604,505 | A | | 8/1986 | Henninger |
| 4,663,542 | A | | 5/1987 | Buck et al. |
| 4,814,759 | A | * | 3/1989 | Gombrich et al. ..... 345/60 |
| 4,844,582 | A | | 7/1989 | Giannini |
| 4,964,891 | A | | 10/1990 | Schaefer |
| 5,031,258 | A | | 7/1991 | Shaw |
| 5,207,148 | A | | 5/1993 | Anderson et al. |
| 5,368,275 | A | | 11/1994 | Ketcham et al. |
| 5,385,468 | A | | 1/1995 | Verderber |
| 5,433,623 | A | | 7/1995 | Wakata et al. |
| 5,450,877 | A | | 9/1995 | Graffin |
| 5,713,752 | A | | 2/1998 | Leong et al. |

(Continued)

FOREIGN PATENT DOCUMENTS

| | | | |
|---|---|---|---|
| EP | 0868077 | A2 | 9/1998 |
| JP | 60033716 | A | 2/1985 |
| JP | 06310202 | A | 11/1994 |
| JP | 06310204 | A | 11/1994 |

(Continued)

*Primary Examiner* — Daniel P Stodola
*Assistant Examiner* — Gwendolyn Driggers

(57) ABSTRACT

A substance communicating device for coupling to a host in at least two distinct orientations, as well as a modular system comprising a host, and a functional device in addition to the substance communicating device. The substance communicating device provides a substance from the host to the functional device. The substance communicating device may be an adapter for coupling the functional device to the host, or a functional unit of an adapter and a functional device. The substance communicating device may include a first member having a first interface connectable to the host, and a second member pivotally connected to the first member and having a second interface connectable to the functional device. The modular system may include a plurality of hosts having differently-oriented substance communication service interfaces and the substance communicating device.

14 Claims, 13 Drawing Sheets

(56) References Cited

U.S. PATENT DOCUMENTS 5,784,934 A 7/1998 Izumisawa
5,828,341 A 10/1998 Delamater
5,953,129 A 9/1999 Anderlik et al.
6,003,734 A 12/1999 Oh
6,176,718 B1 1/2001 Skarie et al.
6,183,264 B1 2/2001 Harsanyi
6,350,148 B1 2/2002 Bartolutti et al.
6,359,270 B1 3/2002 Bridson
6,428,334 B1 8/2002 Skarie et al.
6,445,580 B1 9/2002 Cohen et al.
6,534,951 B2 3/2003 Kawashima
6,559,882 B1 5/2003 Kerchner
6,633,157 B1 10/2003 Yamaki et al.
6,685,491 B2 2/2004 Gergek
6,692,093 B1 * 2/2004 Park et al. ..... 312/405.1
6,921,113 B1 7/2005 Vlasblom
6,927,871 B1 8/2005 Silverbrook et al.
6,969,928 B2 11/2005 Hanson
6,973,936 B2 12/2005 Watson
6,981,695 B1 1/2006 Hedlund et al.
6,986,263 B2 1/2006 Crisp, III
7,024,717 B2 4/2006 Hilscher et al.
7,201,005 B2 4/2007 Voglewede et al.
7,207,080 B2 4/2007 Hilscher et al.
7,207,233 B2 4/2007 Wadge
7,209,038 B1 4/2007 Deconinck et al.
7,264,026 B2 9/2007 Gruber et al.
7,291,032 B1 11/2007 Carver et al.
7,354,292 B1 4/2008 Lloyd et al.
7,404,298 B2 7/2008 Kim et al.
7,430,111 B2 9/2008 Lee et al.
7,493,926 B2 2/2009 Weglin
7,584,030 B1 9/2009 Graham
7,618,295 B2 11/2009 McCoy
7,625,246 B2 12/2009 McCoy et al.
7,639,485 B2 12/2009 McCoy
7,651,368 B2 1/2010 Kendall et al.
7,686,127 B2 3/2010 LeClear et al.
7,689,476 B2 3/2010 Crisp, III
7,713,090 B2 5/2010 Kendall et al.
7,740,505 B2 6/2010 McCoy
7,740,506 B2 6/2010 McCoy
7,748,494 B2 7/2010 Leclear et al.
7,751,184 B2 7/2010 McCoy
7,765,332 B2 7/2010 McCoy et al.
7,798,865 B2 9/2010 McCoy et al.
7,810,343 B2 10/2010 McCoy et al.
7,814,944 B2 10/2010 Weglin
7,826,203 B2 11/2010 McCoy
7,841,907 B2 11/2010 McCoy
7,843,697 B2 11/2010 McCoy et al.
7,852,619 B2 12/2010 McCoy
7,865,639 B2 1/2011 McCoy et al.
7,869,201 B2 1/2011 McCoy et al.
7,870,753 B2 1/2011 Marcy, V et al.
7,871,300 B2 1/2011 McCoy et al.
7,898,812 B2 3/2011 McCoy et al.
7,903,397 B2 3/2011 McCoy
7,916,336 B2 3/2011 Silverbrook et al.
7,931,114 B2 4/2011 LeClear et al.
7,934,958 B2 5/2011 Kendall et al.
7,980,088 B2 7/2011 LeClear et al.
8,008,586 B2 8/2011 Kuehl et al.
8,035,958 B2 10/2011 Kendall et al.
8,040,666 B2 10/2011 McCoy et al.
8,151,016 B2 4/2012 McCoy
8,212,430 B2 7/2012 McCoy
8,314,678 B2 11/2012 Ebrom et al.
8,342,480 B2 1/2013 Hendrickson et al.
8,387,948 B2 3/2013 Kuehl et al.
8,405,253 B2 3/2013 McCoy
8,517,337 B2 8/2013 Kuehl et al.
8,528,610 B2 9/2013 Kuehl et al.
8,745,203 B2 6/2014 McCoy
2001/0017134 A1 8/2001 Bahr
2002/0022991 A1 2/2002 Sharood et al.
2003/0037447 A1 2/2003 Gruber et al.
2003/0154338 A1 8/2003 Boz et al.
2003/0221616 A1 12/2003 Carpenter et al.
2004/0036273 A1 2/2004 McClary
2004/0154318 A1 8/2004 Roh et al.
2004/0202421 A1 10/2004 Iiduka et al.
2005/0011205 A1 1/2005 Holmes et al.
2005/0178273 A1 8/2005 Meuleners et al.
2006/0021659 A1 2/2006 Andersson
2006/0053655 A1 3/2006 Weglin
2006/0113324 A1 6/2006 Rudesill et al.
2006/0118694 A1 6/2006 Lee et al.
2006/0125360 A1 6/2006 Kim et al.
2006/0145576 A1 7/2006 Lee et al.
2006/0168236 A1 7/2006 Higuma et al.
2006/0187080 A1 8/2006 Slatter
2007/0086151 A1 4/2007 Oh et al.
2008/0065289 A1 3/2008 Bertosa et al.
2008/0122585 A1 5/2008 Castaldo et al.
2008/0125911 A1 5/2008 Ebrom et al.
2008/0158172 A1 7/2008 Hotelling et al.
2008/0164224 A1 7/2008 McCoy et al.
2008/0164225 A1 7/2008 McCoy
2008/0164226 A1 7/2008 McCoy et al.
2008/0164227 A1 7/2008 LeClear et al.
2008/0164796 A1 7/2008 McCoy et al.
2008/0165282 A1 7/2008 Marcy et al.
2008/0165474 A1 7/2008 McCoy et al.
2008/0165475 A1 7/2008 McCoy et al.
2008/0165476 A1 7/2008 McCoy et al.
2008/0165478 A1 7/2008 McCoy
2008/0165505 A1 7/2008 McCoy et al.
2008/0165509 A1 7/2008 Kendall et al.
2008/0165998 A1 7/2008 LeClear et al.
2008/0166895 A1 7/2008 McCoy et al.
2008/0166915 A1 7/2008 Kendall et al.
2008/0168205 A1 7/2008 McCoy et al.
2008/0192411 A1 8/2008 McCoy
2008/0201032 A1 8/2008 Fayyad et al.
2008/0222327 A1 9/2008 McCoy et al.
2008/0231464 A1 9/2008 Lewis et al.
2008/0231764 A1 9/2008 Kendall et al.
2008/0232053 A1 9/2008 Kendall et al.
2008/0247141 A1 10/2008 Kendall et al.
2008/0265191 A1 10/2008 Walborn
2008/0287009 A1 11/2008 McCoy
2009/0009316 A1 1/2009 Kendall et al.
2009/0047824 A1 2/2009 Seibert et al.
2009/0050232 A1 2/2009 Guan et al.
2009/0054804 A1 2/2009 Gharib et al.
2009/0161579 A1 6/2009 Saaranen et al.
2010/0007325 A1 1/2010 Stark
2010/0024573 A1 2/2010 Daverman et al.
2010/0052866 A1 3/2010 Elferich et al.
2010/0120284 A1 5/2010 Oka et al.
2010/0182753 A1 7/2010 Kendall et al.
2010/0248546 A1 9/2010 McCoy
2010/0281261 A1 11/2010 Razzell
2011/0049308 A1 3/2011 Beaman et al.
2011/0073214 A1 3/2011 Guan et al.
2011/0146328 A1 6/2011 Hendrickson et al.
2011/0146329 A1 6/2011 Kuehl et al.
2011/0146330 A1 6/2011 Kuehl et al.
2011/0146819 A1 6/2011 Hendrickson et al.
2011/0147159 A1 6/2011 Kuehl et al.
2011/0147160 A1 6/2011 Kuehl et al.
2011/0147161 A1 6/2011 Kuehl et al.
2011/0147417 A1 6/2011 Kuehl
2011/0148216 A1 6/2011 McCoy
2011/0148223 A1 6/2011 McCoy
2011/0148649 A1 6/2011 de Cavalcanti et al.
2011/0148650 A1 6/2011 Jenkins et al.
2011/0148651 A1 6/2011 Hendrickson et al.
2011/0149485 A1 6/2011 Kuehl et al.
2011/0152024 A1 6/2011 Kuehl
2011/0153739 A1 6/2011 McCoy

(56) References Cited

U.S. PATENT DOCUMENTS

| | | | |
|---|---|---|---|
| 2011/0153821 | A1 | 6/2011 | McCoy |
| 2011/0153871 | A1 | 6/2011 | Ferragut, II et al. |
| 2011/0153880 | A1 | 6/2011 | McCoy |

FOREIGN PATENT DOCUMENTS

| | | | |
|---|---|---|---|
| JP | 06333633 | A | 12/1994 |
| JP | 2007080584 | A | 3/2007 |
| WO | 2007/015274 | A1 | 2/2007 |

* cited by examiner

SUBSTANCE COMMUNICATING DEVICE FOR COUPLING TO A HOST

BACKGROUND

Appliances and other useful household equipment are increasingly designed to interact with one another, as well as with a variety of accessory devices. An accessory device may be used, for example, in conjunction with an appliance to enhance or supplement the functionality of the appliance. The accessory device may be configured to be permanently or removably connectable to the appliance. The accessory device may also be operable independently of the associated appliance, thereby requiring a connection mechanism capable of sustaining repetitive attachment cycles.

Operation of the interconnected devices may also involve the transfer of a variety of substances, such as various liquids, gases, and solids. For example, a refrigerator may provide an external water connection for connecting an accessory water dispenser. A freezer section of a refrigerator may include provisions for connecting an accessory ice maker. A washing machine may provide an option for attaching a detergent and/or softener dispenser.

The invention recognizes this trend and attempts to support the trend.

BRIEF SUMMARY

A substance communicating device and a modular system are disclosed. The substance communicating device can be attached to hosts that have differently-oriented substance communication service interfaces.

According to one aspect of the invention, a substance communicating device mounts a functional device to a host having a horizontal surface with an upwardly-oriented host substance communication service interface communicating a first substance. The substance communicating device comprises a first member capable of supporting a functional device, and a second member having a substance communication service interface capable of removably coupling with the host substance communication service interface and receiving the first substance from the host substance communication service interface, wherein the second member is pivotally connected to the first member.

According to another aspect of the invention, a substance communicating device mounts a functional device to a host substance communication service interface capable of providing a mechanical support service and communicating at least one substance. The substance communicating device comprises a first member having a device substance communication service interface capable of removably coupling with the functional device and capable of providing the functional device with mechanical support service and capable of communicating at least one substance with the functional device, a second member having a first substance communication service interface oriented in a first direction and capable of removably coupling with the host substance communication service interface and capable of receiving the at least one mechanical support service and capable of communicating the at least one substance from the host substance communication service interface, and a hinge system pivotally connecting the first member to the second member to pivotally support the second member in a plurality of angular orientations relative to the first member.

According to yet another aspect of the invention, a system for communicating a substance comprises a host having a host substance communication service interface capable of providing a mechanical support service and a substance, the host substance communication service interface having one of a vertical orientation and a horizontal orientation, and a substance communicating device removable coupled with the host. The substance communicating device comprises a first member having a substance communication service interface removably coupled with the host substance communication service interface to receive the mechanical service and the substance from the host substance communication service interface, and a second member capable of supporting a functional device, the second member pivotally connected to the first member to move between at least a first position for connecting to the host substance communication service interface having the vertical orientation, and a second position for connecting to the host substance communication service interface having the horizontal orientation.

According to still another aspect of the invention, an adapter mounts a functional device to a host having a horizontal surface with an upwardly oriented host substance service interface providing at least one substance. The adapter comprises a first member capable of supporting a functional device, a second member having a substance service interface capable of removably coupling with the host substance service interface and receiving the at least one substance from the host substance service interface, wherein the second member is pivotally connected to the first member for movement between a first orientation having a first angular relationship between the first and second members, and a second orientation having a second angular relationship between the first and second members different than the first angular relationship, and a substance pathway configured to communicate the at least substance between the first and second members in both the first and second orientation of the second member.

DETAILED DESCRIPTION

Figure 1:
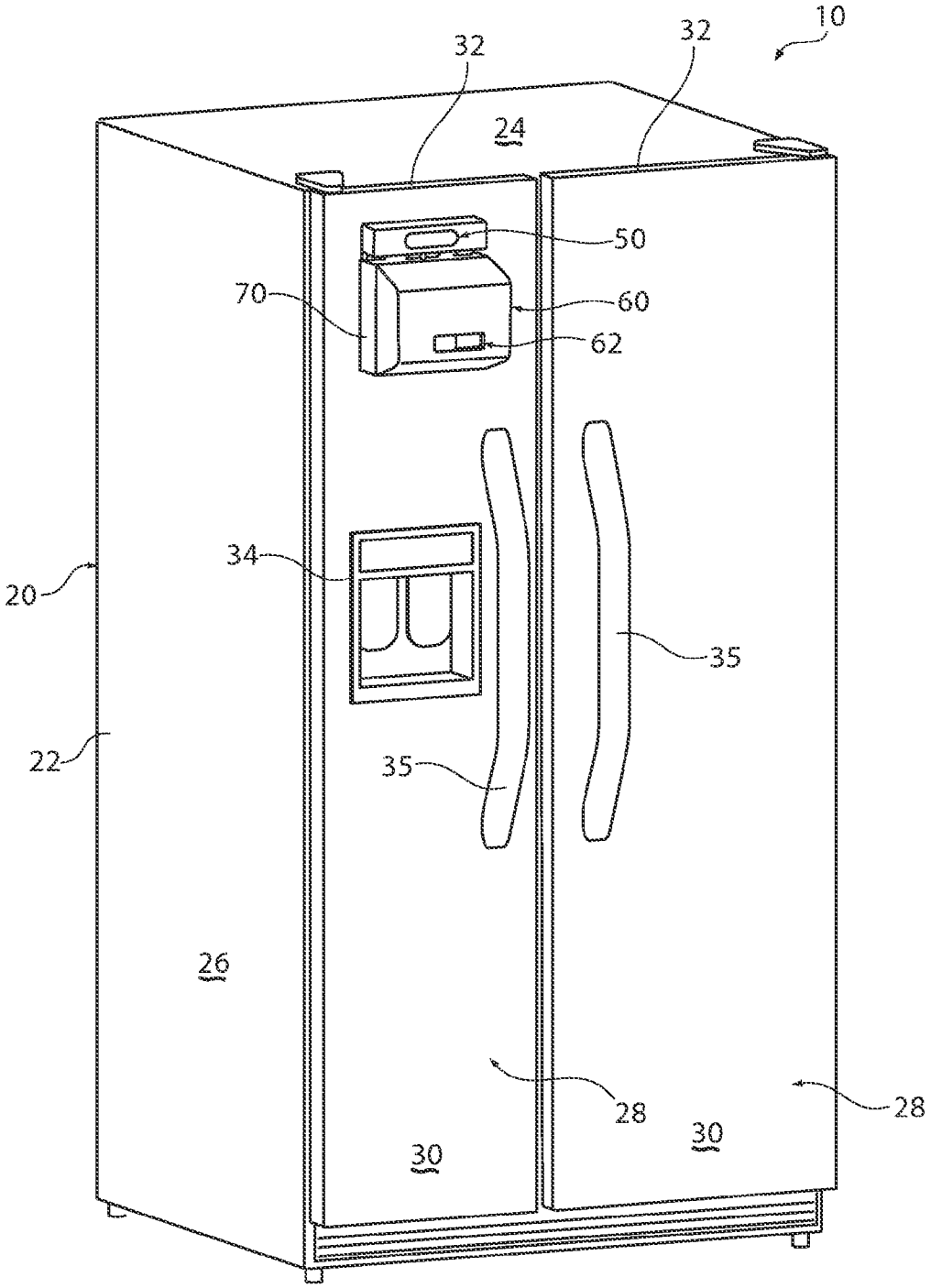
FIG. 1 is a perspective view of a modular system according to one embodiment of the invention employing an adapter for coupling a functional device to a host, and further employing an interface cover for coupling to the adapter or to a host substance communication interface on the host.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present invention. Further, the descriptions set forth herein are not intended to be exhaustive or to otherwise limit or restrict the claims to the precise forms and configurations shown in the drawings and disclosed in the following detailed description.

The drawings and the following detailed description relate generally to a hinged substance communicating device for coupling to a host in at least two distinct orientations. The substance communicating device can be but is not limited to a portable device, an adapter for coupling a portable device to a host, or a functional unit of an adapter and a portable device. The following definitions apply to terms that may be used in the specification and the claims, unless otherwise noted.

As used herein, a "substance" is a material that may be communicated from one device to another. A substance may include a gas, a liquid, or a solid, or any combination thereof. Examples of substances include, but are not limited to, liquid soap, powdered soap, compressed air, tablets, caplets, water, ice cubes, a beverage, as well as others.

The term "consumable" and any variation thereof, as used herein, includes any substance that may be consumed by a host, an accessory device, or a user person, such as food, cosmetics, or medicine. The consumable may, for example, be a substance that is used up and must be replenished for subsequent cycles of operation. For a clothes washer, the consumable might be a detergent and/or a softener. For a clothes dryer, the consumable might be an anti-static cloth. For a cooking or refrigeration appliance, the consumable may actually be the article on which the appliance performs its cycle of operation, as in the case of food, later to be consumed by a person. More specific examples of the use of a consumable in appliances include dispensing additives for clothes washers, clothes dryers, or combination washer/dryer appliances. The additives can include, but are not limited to, normal detergents, gentle detergents, dark clothing detergents, cold water detergents, fabric softeners, chlorine bleaches, color-safe bleaches, and fabric enhancement chemistry. Non-limiting examples of fabric enhancers are additives to provide stain resistance, wrinkle resistance, water repellency, insect repellency, color fastness, fragrances, and anti-microbials. Another example of a consumable is the filters used by an appliance. Refrigerators, dryers, washers, and dishwashers are all known to use filters that are consumed in the sense that they wear out and must be replaced.

As used herein, "substance communication" or a "substance communication service" is a useful provision of a substance from one device to another device. Communicating a substance includes supplying or receiving a substance. As used herein, communication of substance includes both uni-directional and multi-directional communication between any two devices, either directly or through an adapter, as defined herein. Substance communication may be provided in quanta, such as capsules or other doses of substances, batches of discrete items such as tablets, or consumable components.

The term "coupled" and any variation thereof, as used herein, includes any type of connection that permits transfer of a substance between two devices. The term "coupled" does not require a physical connection between the two devices, so long as the coupling permits transfer of a substance. The term "coupled" includes both fixed and removable coupling, as well as both continuous and intermittent coupling.

"Communicating a substance communication service" or "communicating a substance," means supplying or receiving a substance communication service or a substance. As used herein, communication of a substance communication service or a substance includes both uni-directional and multi-directional communication, between any two devices, either directly, or through an adapter, as defined herein.

The terms "provide" and "supply" and any variation thereof, are used herein to denote a source of the substance relative to a device receiving the substance. Neither term is limited to the original source of the substance. A device that provides or supplies the substance may simply be passing on the substance from the original source. For example, a device that provides water may pass on water it receives from a residential water supply. However, the device may alternatively or additionally provide another substance that originates with the device, such as an additive stored in a reservoir.

The term "receive" and any variation thereof is used herein to denote receipt of the substance relative to the device providing the substance. The term not limited to the ultimate consumer of the substance. A device that receives a substance may simply be passing on the substance from the source, such as an appliance, to a device that will consume, as hereinafter defined, the substance. The device which receives a substance is not necessarily the end consumer of the substance.

The term "consume" and any variation thereof, as used herein, denotes the act of employing or dispensing at least a portion of the substance received in connection with performing a function.

The term "useful device" and any variation thereof, as used herein, is a device that is capable of performing a useful physical or virtual function either alone or in combination with another device.

The term "substance consumer" and any variation thereof, as used herein, is any useful device that employs, uses, stores, or dispenses a substance in connection with performing a physical or virtual function. A substance consumer may be, for example, a smart utensil, an appliance, a resource controller, such as a water controller, a dispenser, a filter, a water filter, an air filter, a detergent dispenser, a drink dispenser, a detergent cartridge, and a substance holder, such as a bottle, a jug, or a cycle accessory.

The term "substance provider" and any variation thereof, as used herein, is any device that is capable of providing or supplying a substance to another device.

A "substance communicating device" is any substance holder, substance provider, or substance consumer which is capable of communicating substance with another device.

A "substance communicating system" is any combination of substance communicating devices capable of communicating a substance therebetween.

As used herein, the term "substance holder" is anything that holds or contains a substance, which may include, but is not limited to, a container, a dispenser, a cartridge, a dish, a bag, or a carton.

As used herein, the term "consumable holder" is any substance holder that holds or contains a consumable.

As used herein, the term "host" is an apparatus that has a primary function independent of providing or receiving a substance. A host may be a substance provider, a substance consumer, or both. For example, the host may be an appliance and the primary function can be performing a series of steps to conduct a useful cycle of operation. The appliance may be a conventional household appliance, such as a refrigerator performing a cooling cycle or an ice making cycle. Other examples of appliances that may be hosts include, but are not limited to, a freezer, a conventional oven, a microwave oven, a dishwashing machine, a stove, a range, an air conditioner, a dehumidifier, a clothes washing machine, a clothes dryer, a clothes refreshing machine, and a non-aqueous washing apparatus, or any combination thereof. Alternatively, the host may be a fixture such as a water softener, a water heater, a furnace, pool water treatment equipment, or an HVAC system. The host may be a small device such as a thermostat, a blender, a mixer, a toaster, a coffee maker, a trash compactor, an air purifier, an iron, a vacuum cleaner, or a robot. The host may alternatively comprise a structural feature of a building, such as a wall, a cabinet, or a door. Additional examples of hosts include furniture, such as a desk or a sofa; a part of a vehicle, such as a car dashboard; an air craft passenger seat; a bicycle handle; and a shopping cart handle. The host may also provide other services, such as electrical power, electronic data, mechanical power, illumination, heat, or sound.

As used herein, the terms "accessory" or an "accessory device" refer to any useful device which may be coupled to a host and communicate a substance to or from the host. An accessory device may be used primarily in conjunction with a host to enhance, supplement, regulate, or monitor the functionality of the host or may have independent functionality and utility. An accessory device may be a substance provider, a substance consumer, or both. An accessory device may be a substance holder or a consumable holder. Examples of an accessory device include, but are not limited to, a paper product dispenser, a dry goods dispenser, a bottle opener, a liquid dispenser, a pill dispenser, a water dispenser, a fan, a motor, a tissue dispenser, a can opener, a mixer, a blender, an ice dispenser, an ice maker, an ice cream maker, a coffee maker, a soap dispenser, and a softener dispenser. An accessory or accessory device may also communicate electromagnetic service with the host.

As used herein, the term "portable device" is an accessory device that is designed to be moveable by a user during its useful life between a use location and a storage location or alternative use location.

As used herein, the term "independent device" is a useful device that provides a useful function without being connected to a substance provider. In some cases the primary function of the independent device is different from the primary function of a host from which the independent device may receive a substance. The independent device may be an accessory device.

As used herein, the term "dependent device" is a useful device that provides a useful function only when connected to a substance provider. A dependent device may be a substance consumer. Examples of a dependent device that may be coupled to a host include, but are not limited to, a smart pan or pot, an ice maker, and a bulk detergent dispenser.

A "functional device" may be a substance provider, a substance consumer, an accessory device, a portable device, an independent device, a dependent device, or any other substance communicating device, or any combination thereof.

As used herein, the term "plug" is a generally male substance connection component.

As used herein, the term "receptacle" is a generally female substance connection component.

As used herein, the terms "substance line" or "substance pathway" refer to a pathway for transferring a substance from one location to another. The substance line may have any of a variety of configurations depending on the type of substance being transferred, including, but not limited to, a pipe, a conduit, a tube, a channel, or fludically-aligned supply and receiver ports with a gap therebetween.

As used herein, the term "adapter" is an intermediate device that may be provided between a first and second useful device, such as between a host and an accessory, to facilitate the communication of substances between the first and second useful devices. An adapter may receive a substance from the first useful device and provide the substance or a modified version of the substance to the second useful device, for example, by providing a substance dispensing through a metering process, by processing the substance, or by combining the substance with an additive. In some applications, multiple adapters may be interposed between two useful devices. In other applications, three or more useful devices may be coupled to a single adapter, such as multiple accessories for a host. In some applications, the adapter may itself be a useful device providing a useful function not provided by the other useful device or devices coupled to it. An adapter may optionally include a transformative component that transforms a service from a service provider to a different service, which is supplied to a service consumer. This may be useful when the service from the service provider is not compatible with the service consumer. The transformative component can be configured to transform the service into a compatible form for the service consumer. Examples of transformative components are protocol converters, power transformers, or other devices that convert substance, energy, or data from a first form to a second form.

As used herein, the term "functional unit" is the combination of any adapter coupled to an accessory, which together provide functionality that neither the adapter nor the accessory can alone provide. Any functional unit itself is also included within the meaning of the term "useful device". In some cases, it is contemplated that a dependent device may be coupled with an adapter that provides one or more services required by the dependent device to enable the functional unit to provide a useful function, in which case the functional unit also constitutes an independent device.

A modular system having a hinged adapter as illustrated and described in detail herein enables the coupling of a functional device, such as a service consumer or service provider, with hosts in at least two distinct applications. The hinged nature of the hinged adapter enables the hinged adapter to be attached to various hosts that have differently-oriented substance communication service interfaces. For example, a first host, such as a refrigerator, might have an upwardly-oriented substance communication service interface, while a second host, such as a wall, might have an outwardly-oriented substance communication service interface. The hinged service consumer may alternatively communicate a substance with the first host and with the second host by adapting its substance communication service interface orientation to the orientation of each host's respective substance communication interface. The adapting can be accomplished by pivotally moving the substance communication service interface of the hinged service consumer to an orientation suitable for coupling with a desired host's substance communication interface.

The hinged service consumer is capable of coupling to a substance provider and directly consuming substance from the substance provider and/or providing substance from a substance provider to a functional device, which may also be a second service consumer. The hinged service consumer may include a first member having a first substance communication interface connectable to a substance provider, the first member being pivotally connected to a second member having a second substance communication interface connectable to a functional device. The modular system may comprise a plurality of hosts having differently-oriented substance communication service interfaces and the hinged service consumer.

Figure 18:
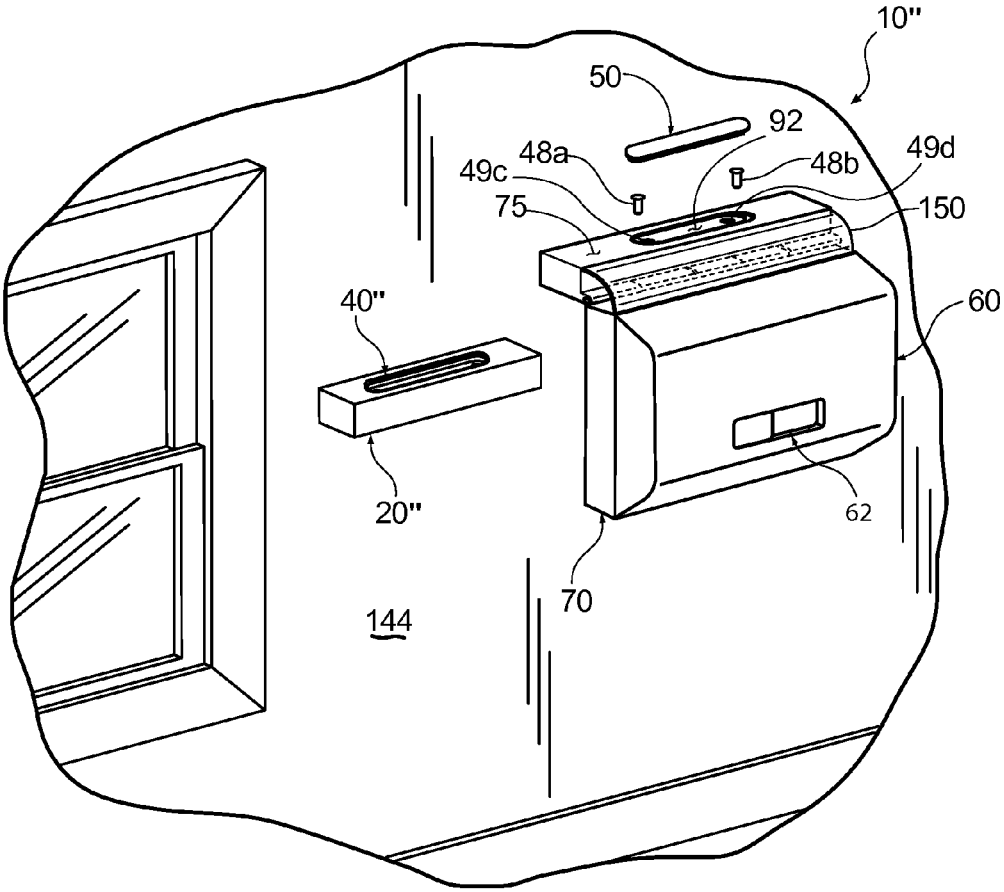
FIG. 18 is a perspective view of a modular system according to a third embodiment of the invention similar to the modular systems of FIGS. 1 and 9 and employing the adapter for coupling the functional device to an alternative host, and further employing the interface cover for coupling to the adapter or to a host substance communication interface on the alternative host.
Figure 19:
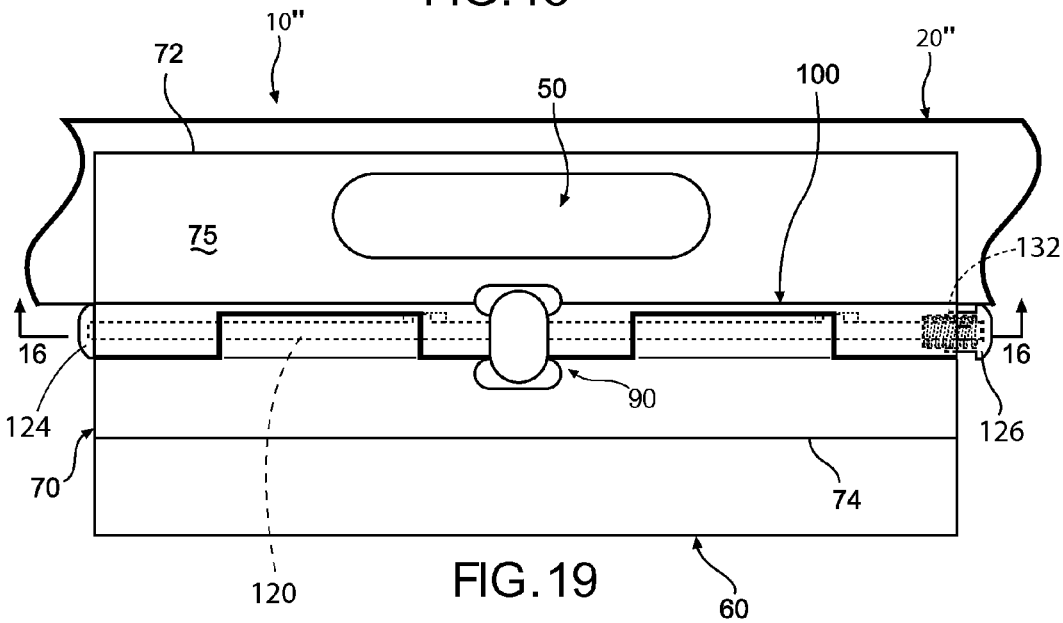
FIG. 19 is a partial top plan view of a second alternative adapter suitable for use with any of the modular systems of FIGS. 1-7, FIGS. 9-15, and FIG. 18 showing the second alternative adapter decoupled from the host of FIG. 18 and utilizing a single-pin hinge system, and also showing the functional device coupled to the second alternative adapter.

Referring now to the drawings, FIGS. 1-7 depict a modular system 10 comprises a host 20 having a host substance communication service interface 40, an adapter 70, and a functional device 60. FIGS. 9-15 depict a modular system 10' comprising adapter 70, functional device 60, and host 20', and further comprising a host substance communication service interface 40' oriented differently from but otherwise substantially similar to the host substance communication service interface 40 of FIGS. 1-7. FIGS. 18 and 19 depict a modular system 10" comprising adapter 70 and functional device 60, as well as a different host 20" having a host substance communication service interface 40" included on host 20".

Figure 2:
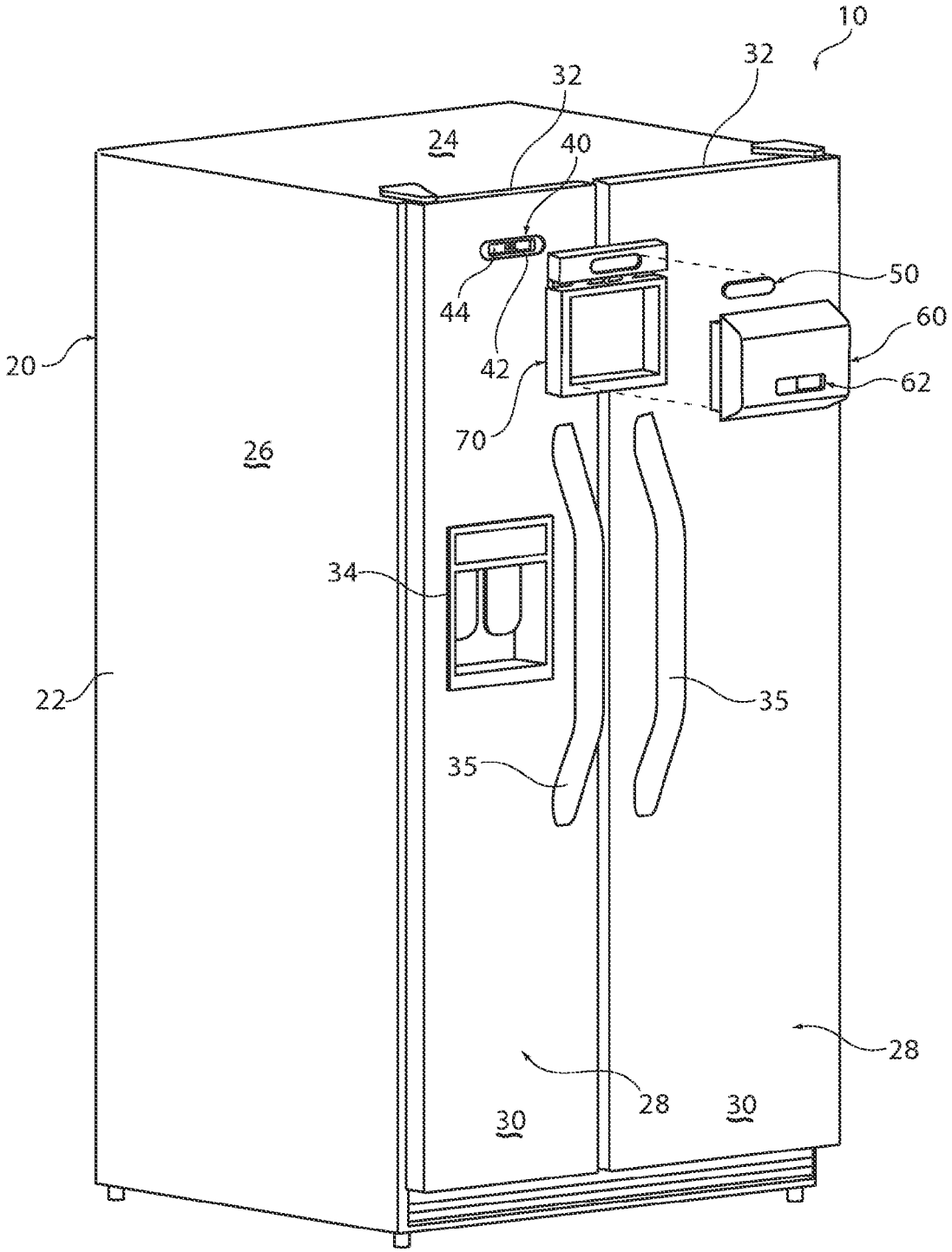
FIG. 2 is a perspective view of the modular system of FIG. 1 showing the adapter, the functional device, and the interface cover decoupled from the host and from one another.
Figure 3:
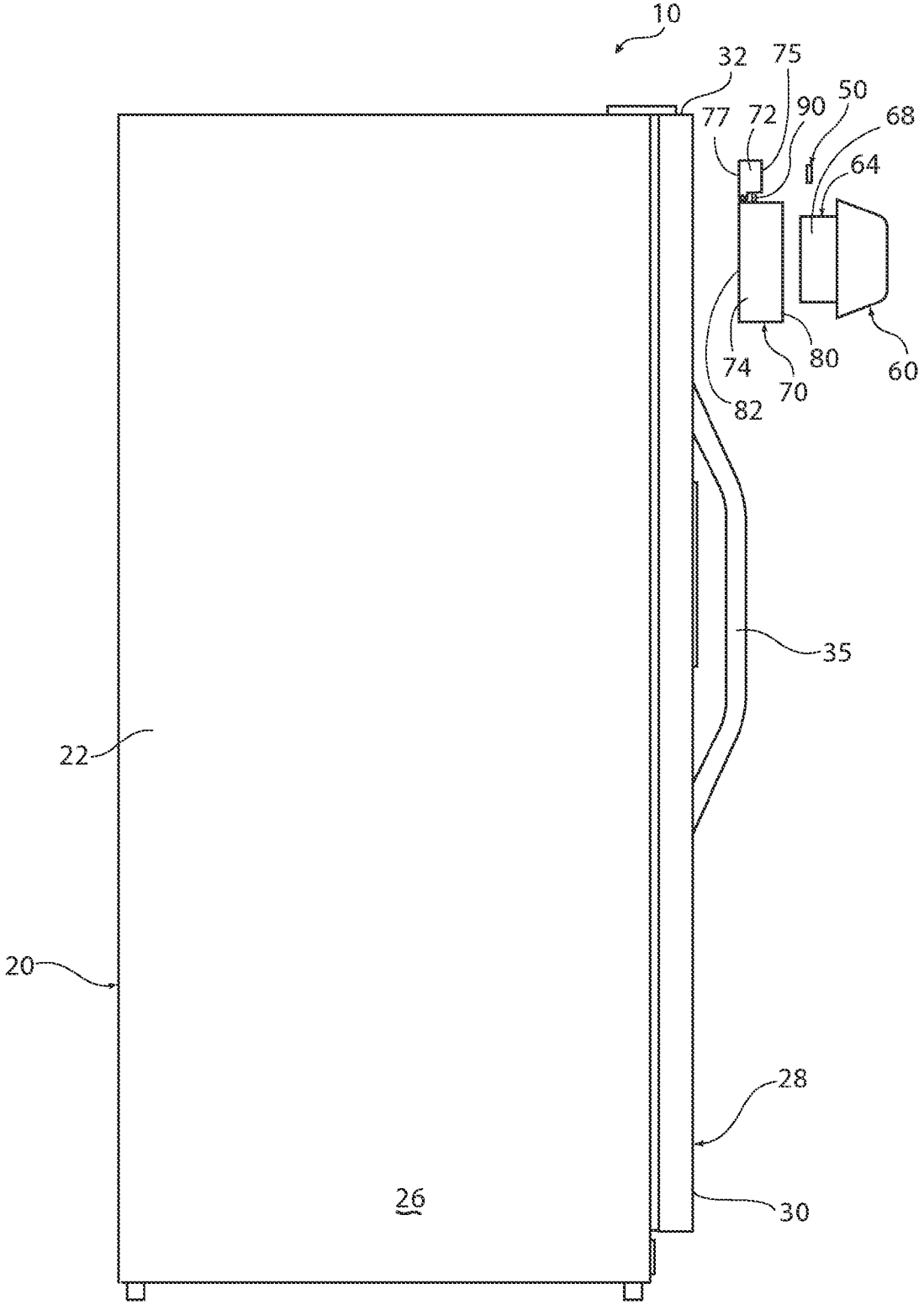
FIG. 3 is a side elevational view of the modular system of FIG. 1 showing the adapter, the functional device, and the interface cover decoupled from the host and from one another.

Referring to FIGS. 1-2, the first embodiment of the modular system 10 can include the host 20, which is illustrated as a refrigerator, and the host substance communication service interface 40. Modular system 10 further includes the adapter 70 and the functional device 60. The adapter 70 is configured to be coupled to the host substance communication service interface 40. The functional device 60, which can be but is not limited to a medicine cooler and/or dispenser, is configured to be coupled to the adapter 70.

Host 20 comprises a structure capable of providing a mechanical support service. In the modular system 10, the host 20 is an appliance, which is illustrated as a refrigerator. Furthermore, other suitable hosts may comprise a structure other than an appliance that can also supply a mechanical support service. As shown in FIG. 18, an alternative host 20" can comprise a wall mounted service unit.

Host 20 provides a mechanical support service to at least one host substance communication service interface 40, which may in turn provide a mechanical support service to the adapter 70. The adapter 70 may in turn provide a mechanical support service to the functional device 60. Mechanical support service is the direct and indirect physical coupling of two objects, such as between any combination of the host 20, the adapter 70, and the functional device 60. The mechanical support service may include direct and indirect physical mounting, unless expressly stated otherwise. Physical coupling can comprise a fixed or removable mounting, unless expressly stated otherwise. As an example, two possible categories of mechanical support services comprise coupling via hanging and coupling via docking.

The host 20 can comprise a cabinet 22 with various surfaces and features, such as a horizontal top surface 24 and vertical side surface 26, as well as internal surfaces (not shown) within the cabinet 22. The host 20 can further include a pair of doors 28 hingedly connected to the cabinet 22, each door 28 having various surfaces and features such a vertical front face 30, a horizontal top edge 32, and handles 35. One of the doors 28 can comprise an ice and water dispenser 34.

The host 20 may be a service provider, and both the functional device 60 and the adapter 70 may be service consumers. Alternatively, functional device 60 may be a service provider, and the adapter 70 and host 20 may be service consumers. Although the functional device 60 in the illustrated embodiment is described as being removable from the adapter 70, the functional device 60 may alternatively be incorporated into the adapter 70.

The host substance communication service interface 40 may be removable or non-removable from the host 20. For example, the host substance communication service interface 40 may be integrally formed with the host 20. Alternatively, the hose substance communication service interface 40 may be a separate add-on device.

The host substance communication service interface 40 can be provided on one of the surfaces or features of the host 20, such as on the vertical front face 30 of one of the doors 28, as illustrated in FIGS. 1-7. Alternatively, the host substance communication service interface 40 may be provided at the other surfaces and features of host 20, such as at the top surface 24 or the side surface 26 of the cabinet 22, at the ice and water dispenser 34, or on an inner surface or feature (not shown) of the host 20 within the cabinet 22. Other hosts (not shown) may have multiple host substance communication service interfaces having the same or different orientations and each configured for coupling with the adapter 70.

In addition to the mechanical support service provided to adapter 70, the host substance communication service interface 40 communicates at least one substance communication service with the adapter 70. More particularly, when coupled with adapter 70, host substance communication service interface 40 communicates the at least one substance communication service with the adapter 70, either by providing or receiving the at least one substance communication service to or from the adapter 70. The adapter 70 may in turn use the at least one substance communication service and/or communicate the at least one substance Where the host is a functional apparatus, such as the host 20 comprising an appliance, which uses or generates a substance communication service, it may communicate that substance communication service with the host substance communication service interface 40. For example, the ice and water dispenser 34 of the host 20 illustrated in FIG. 1 may use and provide water and may also use a cooling service, all of which as substance communication services. Any of these substance communication services may be communicated by host 20 through host substance communication service interface 40 so as to be available to be communicated with adapter 70. Alternatively, the host substance communication service interface 40 may obtain the at least one substance communication service through host 20, but an additional substance communication service may be provided from a source independent of the host 20, such as a home water system or other utility system. Additional substance communication services that can be communicated by host substance communication service interface 40 may include any substance communication service as defined herein, such as but not limited to fluid substance communication services, gas substance communication services, and solid substance communication services. The substance communication service may be communicated between any combination of the host 20, adapter 70, and functional device 60.

Figure 4:
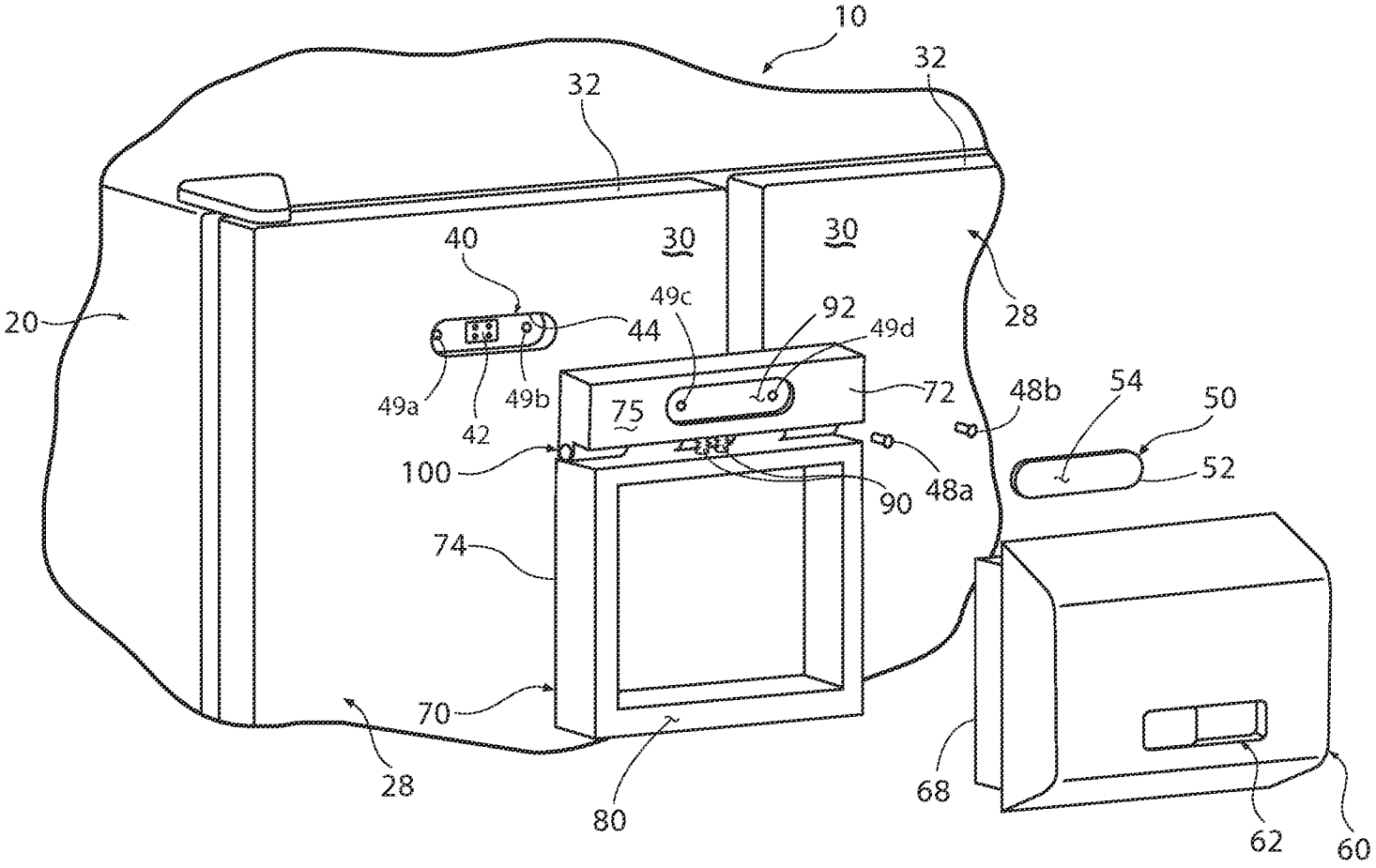
FIG. 4 is a partial front perspective view of the modular system of FIG. 1 showing the adapter, the functional device, and the interface cover decoupled from the host and from one another.
Figure 5:
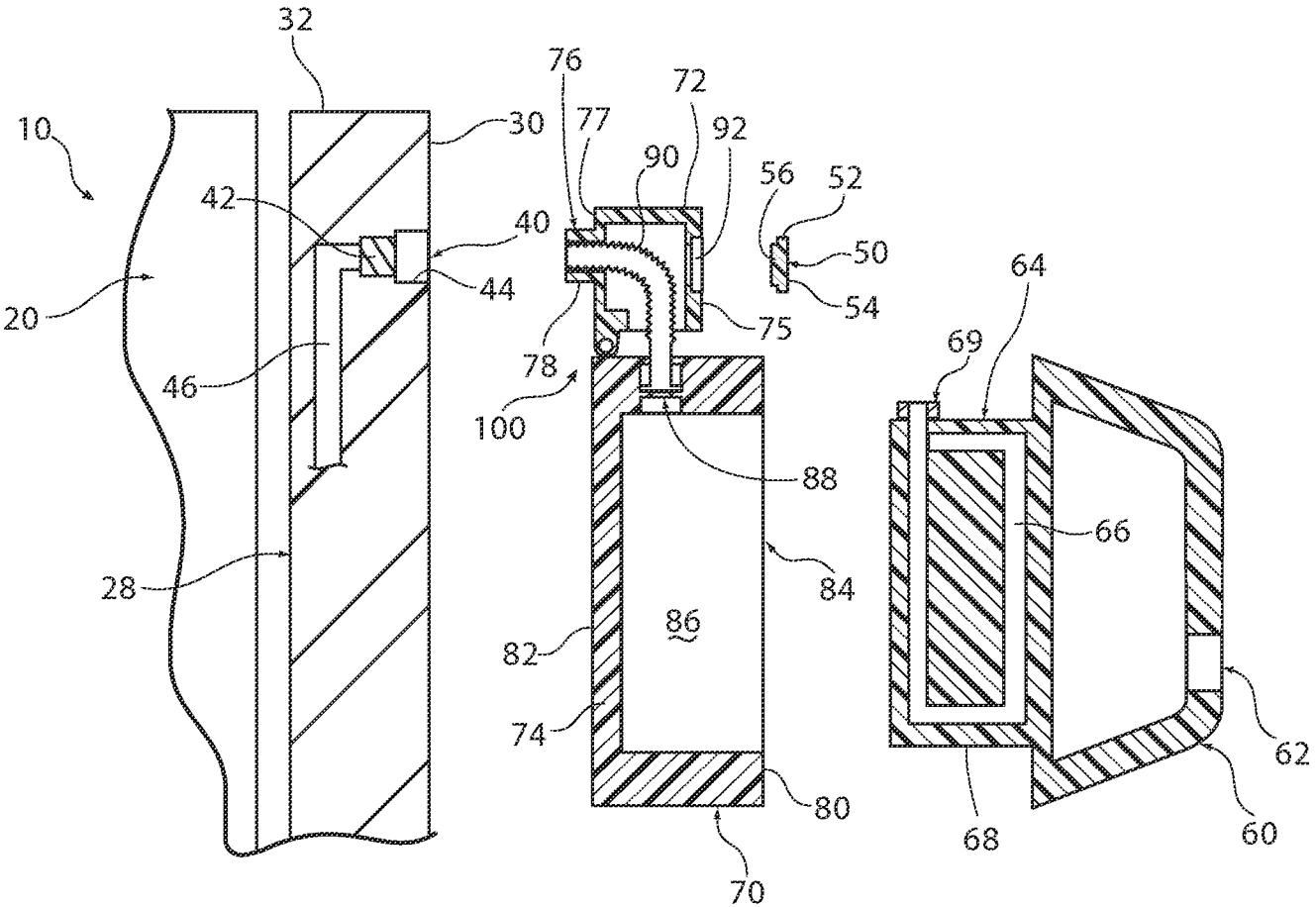
FIG. 5 is a partial side cross-sectional view through the modular system of FIG. 1 showing the adapter, the functional device, and the interface cover decoupled from the host and from one another.

Referring to FIGS. 4-5, the host substance communication service interface 40 may include a host coupler 42 incorporating a substance communication service coupling feature. The host coupler 42 may be disposed in a recess 44 in a surface of the host 20 or in a component of the communication service interface 40. The substance communication service is communicated to host coupler 42 by way of at least one line 46 extending from host coupler 42 to a substance provider, such as a consumer system (not shown) within or external to the host 20 that provides or uses the substance communication service. If the substance corresponding to the substance communication service is a consumable substance, for example, line 46 may be a single tube, and the substance provider may comprise a pump, a reservoir, or a dispenser. Adapter 70 may in turn consume the substance or communicate the substance to the functional device 60. The substance may, for example be any fluid or gas that may be capable of producing heat, movement or power when consumed, such as fuel, a food additive, or blown air. If the fluid is a cooling fluid, line 46 may comprise two fluid conduits, including a supply line and a return line, and the substance provider and the substance consumer may each include portions of a refrigeration system, such as a compressor, a condenser, and/or an evaporator. In other potential scenarios, the substance may be a secondary cooling fluid that transfers heat indirectly. The secondary cooling fluid may be any substance that includes sufficient heat transfer characteristics suitable for the particular application. Non-limiting examples of secondary cooling fluid include water, a glycol and water solution, or brine.

Host coupler 42 may comprise a socket or receptacle configured to accept a complementary plug associated with the adapter 70 that directly mates with the host coupler 42. Alternatively, the host coupler 42 can comprises a contact point between the host substance communication service interface 40 and the adapter 70, and the various components can be aligned by other features of the host substance communication service interface 40 and the adapter 70. It will be appreciated that the configuration of the host coupler 42 may be chosen based on the particular host substance communication service interface 40 being used and can incorporate any necessary seals, shields, shut offs, and other features as are required for the type of substance communication service or any other service being communicated by the host substance communication service interface 40.

Mechanical support service provided to adapter 70 may also be at least partially communicated by host coupler 42. For example if host coupler 42 comprises a mating receptacle and plug system, some mechanical support may be provided by the mechanical cooperation between the receptacle and the plug. The mechanical support service to adapter 70 may also or alternatively be at least partially communicated by using one or more mounting screws 48*a*, 48*b* disposed on either side of coupler 42 and configured for insertion into corresponding holes 49*c* and 49*d* formed in the adapter 70. The mechanical support service can alternatively be communicated by providing one or more anchor receivers (not shown) accepting anchors (not shown) extending from adapter 70. The host substance communication service interface 40 can also include corresponding holes 49*a*, 49*b* configured to align with the holes 49*c*, 49*d*, respectively, in the adapter 70 so as to receive a portion of the mounting screws 48*a*, 48*b*, respectively, so as the mount the adapter 70 to the host 20. The host coupler 42 may be standardized so that it may be used by multiple adapters 70 for coupling different types of functional devices 60 to a variety of hosts 20.

Different categories of host substance communication service interfaces 40 may provide more than one substance communication service or more than one variation of a category of service, and/or may have more than one host coupler 42. Adapters 70 may be used with such substance communication service interfaces and may or may not take advantage of all of the substance communication services or host couplers 42 provided by/within a particular host substance communication service interface 40. In such a scenario, the adapter 70 can communicate at least the mechanical support service and at least one substance communication service with the host substance communication service interface 40. For example, a host substance communication service interface 40 may be capable of communicating at least one fluid, at least one solid, and at least one gas. A first adapter 70 for use with this host substance communication service interface 40 may communicate only one or two of these substance communication services, while another adapter 70 for use with the same host substance communication service interface 40 may communicate a single of these substance communication services, all of these substance communication services, or a different combination of these substance communication services.

Functional device 60 can be configured for being removably coupled to host 20 via the adapter 70. Functional device 60 can be a device that performs a primary function independent of host 20. In the drawings, functional device 60 is a portable device where the primary function is storing, preserving, and/or dispensing a substance. The substance stored may be communicated with host 20 and may be the same as or different from the substance communicated with host 20. Alternatively, functional device 60 may perform some mechanical activity using the substance communicated from host 20. Examples of such devices include fans, air treatment systems, heaters, and cooling systems.

Functional device 60 may include one or more functional components 62 associated with the functionality of functional device 60. Functional components 62 can use or provide at least one service. Examples of functional components 62 include a video display, user interface, microprocessor, dispenser, a speaker, knobs or buttons, a data display, a keypad, a microphone, a camera, a fan bade or a power generation system. Functional component 62 may provide a user interface to enable a user to interact with the functional device 60 and/or to receive functional output from the functional device 60.

As a non-limiting example, the functional device 60 can be a medicine module. A medicine module may provide convenient access to and visibility of a supply of medicine for a user and enable control of temperature and humidity independently of the host 20 by the use of a secondary substance communicated from host 20, such as a coolant, or alternatively by treated air supplied by host 20. The functional component 62 of the functional device 60 can further include a storage and dispensing system. Thus, a first substance, such as air or coolant, can be communicated with the host 20, and a second substance, such as medicine, can be stored and dispensed by the functional device 60.

Functional device 60 can further include a device substance communication service interface 64 connected by at least one line 66 to functional component 62 to enable communication of both the mechanical support service and the substance communication service to the adapter 70. When coupled to the host 20, functional device 60 may communicate a variety of services through device interface 64. The device substance communication service interface 64 may include a mechanical system, such as a gripping or interlocking system (not shown) for mechanically coupling the functional device 60 to the adapter 70. Alternatively, the device substance communication service interface 64 may communicate the mechanical support service via the incorporation of external features, such as peripheral surface 68, that are configured to accommodate the adapter 70. Device substance communication service interface 64 may include electrical contacts 69 for electrically coupling functional device 60 with the adapter 70. Alternatively, device substance communication service interface 64 may include another coupler (not shown) for communicating additional services, and the additional coupler can include mechanical coupling features for mechanically coupling functional device 60 to the adapter 70.

With continued reference to FIGS. 4-5, adapter 70 is configured to removably couple with host substance communication service interface 40 and to receive at least one mechanical support service and at least one additional service from the host substance communication service interface. Adapter 70 is provided because it may be desirable to couple functional device 60 to a host 20 that is not configured to be directly coupled with the functional device 60 because the host substance communication service interface 40 may not be compatible with the device substance communication service interface 64. The functional device 60 and host 20 are therefore indirectly coupled via adapter 70.

Adapter 70 comprises upper and lower members 72 and 74 pivotally connected together by a hinge system 100, described later in detail. Upper member 72 can be generally rectangular in shape and can comprise a front side 75, a backside 77 and a first adapter substance communication service interface 76 extending rearwardly from the backside 77 and capable of coupling with host substance communication service interface 40. First adapter substance communication service interface 76 may include a first adapter coupler 78 insertable into recess 44 to couple with host coupler 42. For example, if host coupler 42 is a socket, first adapter coupler 78 can be a plug capable of coupling with the socket. Alternatively, first adapter coupler 78 and host coupler 42 may be provided with fittings that have no mechanical engagement function and can be aligned and coupled by cooperating mechanical coupling systems of host substance communication service interface 40 and adapter 70, such as the screws 48*a*, 48*b* and holes 49*a-d* described previously herein. Upper member 72 may have additional contacts and/or couplers for communicating additional services with the host 20. These additional contacts and/or couplers may be associated with first adapter coupler 78 or may be independent thereof.

Lower member 74 can comprise a front side 80 and a backside 82 and is configured to receive at least a portion of the functional device 60 for purposes of providing the mechanical support service to functional device 60. Lower member 74 also provides the substance communication service to functional device 60. Accordingly, member 74 is provided with a second adapter substance communication service interface 84 on the front side 80 thereof capable of coupling with device substance communication service interface 64. Second adapter substance communication service interface 84 may include a recess 86 formed in front side 80 for accepting a portion of functional device 60 and for coupling with features of peripheral surface 68 of functional device 60 to couple functional device 60 to the adapter 70. Second adapter interface 84 further includes a second adapter coupler 88 capable of coupling with the substance communication service interface 64 for communicating the substance between functional device 60 and adapter 70. Lower member 74 may have additional contacts and/or couplers for communicating additional services with the host functional device 60. These additional contacts and/or couplers may be associated with second adapter coupler 88 or may be independent thereof. Adapter 70 further includes at least one substance line 90 connecting first adapter coupler 78 to second adapter coupler 88 and extending around or through a hinge system 100 as will be described in more detail hereinafter. As illustrated, there are two substance lines 90 that form a portion of a substance pathway extending between the members 72, 74. The substance pathway may be considered to extend between the host 20 and functional device 60 via the adapter 70.

Adapter 70 may also transform a substance received from the host substance communication service interface 40 or the device substance communication service interface 64 before providing the transformed substance to the other of the host substance communication service interface 40 and the device substance communication service interface 64. For example, the adapter 70 may heat, cool, mix, or otherwise process a substance, or may add an additive to the substance.

Adapter 70 may have added functionality such as a user interface (not shown) that may be used to communicate a service with host 20 or functional device 60 when the adapter 70 is coupled to the host 20 or the functional device 60, respectively. The adapter 70 may include a system (not shown) for storing one or more substances received from host 20 and for later providing the received substance(s) to functional device 60. When the adapter 70 has additional functionality, adapter 70 may communicate some services with the host substance communication service interface 40 or functional device 60 without communicating said services between host substance communication service interface 40 and functional device 60.

Adapter 70 may have added functionality unrelated to the supplying of a service between host 20 and functional device 60. Adapter 70 may have a functionality that may operate independently of host 20 and functional device 60, or it may enhance one or more of the functions of host 20 or functional device 60. The functionality may be dependent upon whether adapter 70 is coupled with host 20, and also on whether functional device 60 is coupled with adapter 70. The functionality may permit the adapter 70 and/or the functional device 60 to be used independently of host 20. Examples of such adapter functionality include but are not limited to a speaker, a user interface, a display projection, a media manager, a whiteboard, physical storage, application software hosting, communications routing, power storage, a microphone, a mixing chamber, a process delay, such as a physical timer, electronic timer, a reaction inhibitor, or a reaction catalyst, an evaporator, a compressor, a condenser, and a data storage device. An adapter 70 with physical storage functionality may comprise a storage compartment (not shown) for storing items, and may be particularity useful for storing companion items for functional device 60, such as a spoon or other measuring or metering device. Adapter 70 may also have power storage functionality, such as but not limited to a rechargeable battery for providing power to functional device 60.

As best shown in FIGS. 4-5, modular system 10 further includes a detachable interface cover 50. Detachable interface cover 50 provides host 20 with a finished appearance by covering any unused components of the coupler, such as sockets or connectors, and further protects unused couplers from unintentional access or damage.

Interface cover 50 may fill an aesthetic function, by being made to conform to the color and contour of host 20, such as by matching the finish of door 28, handles 35, or ice and water dispenser 34 of the host 20. Alternatively, interface cover 50 may contrast with the finish of the refrigerator.

Interface cover 50 is provided with a flange-like face portion 52 having an ornamental surface 54 and mounting system such as a mounting projection 56. The mounting projection 56 is alternately insertable into the recess 44 in the surface of host 20 or the recess 92 in the adapter 70. Alternatively, other coupling or fastening systems may be used to attach interface cover 50 to host 20 or adapter 70.

To prevent interface cover 50 from being misplaced or lost when adapter 70 and functional device 60 are coupled to host substance communication service interface 40, and to permit it to continue to provide its information function, where applicable, interface cover 70 may alternatively be attached to adapter 70 when adapter 70 is attached to host substance communication service interface 40. For example, a recess 92 may be provided on front side 75 of member 72 of adapter 70 opposite adapter coupler 78 and can be configured to be selectively closed by the cover 50 to protect or hide screws 48*a*, 48*b* and/or other features of first adapter substance communication service interface 76 that would be otherwise exposed. Alternatively, interface cover 50 may be used to cover an additional host substance communication service interface, not shown, provided on adapter 70 for the sequential or ganged mounting of additional adapters 70, not shown.

Figure 6:
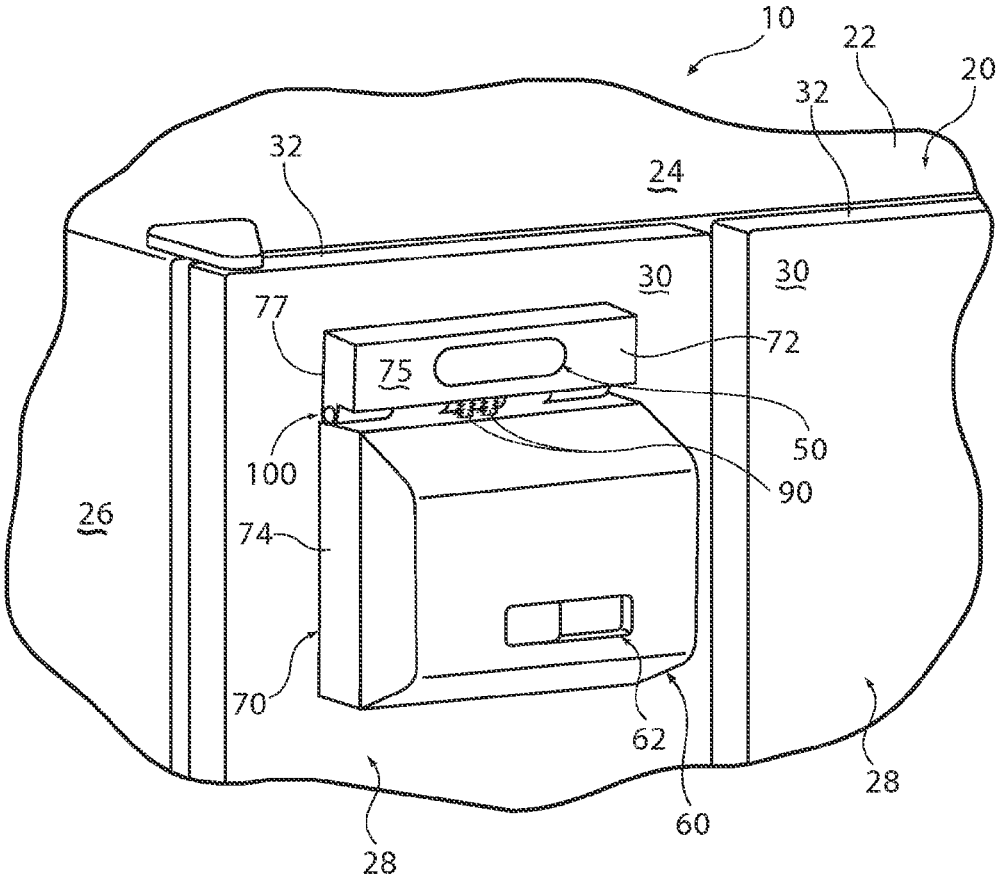
FIG. 6 is a partial front perspective view of the modular system of FIG. 1 showing the adapter coupled to the host substance communication interface on the host and the functional device and the interface cover coupled to the adapter.
Figure 7:
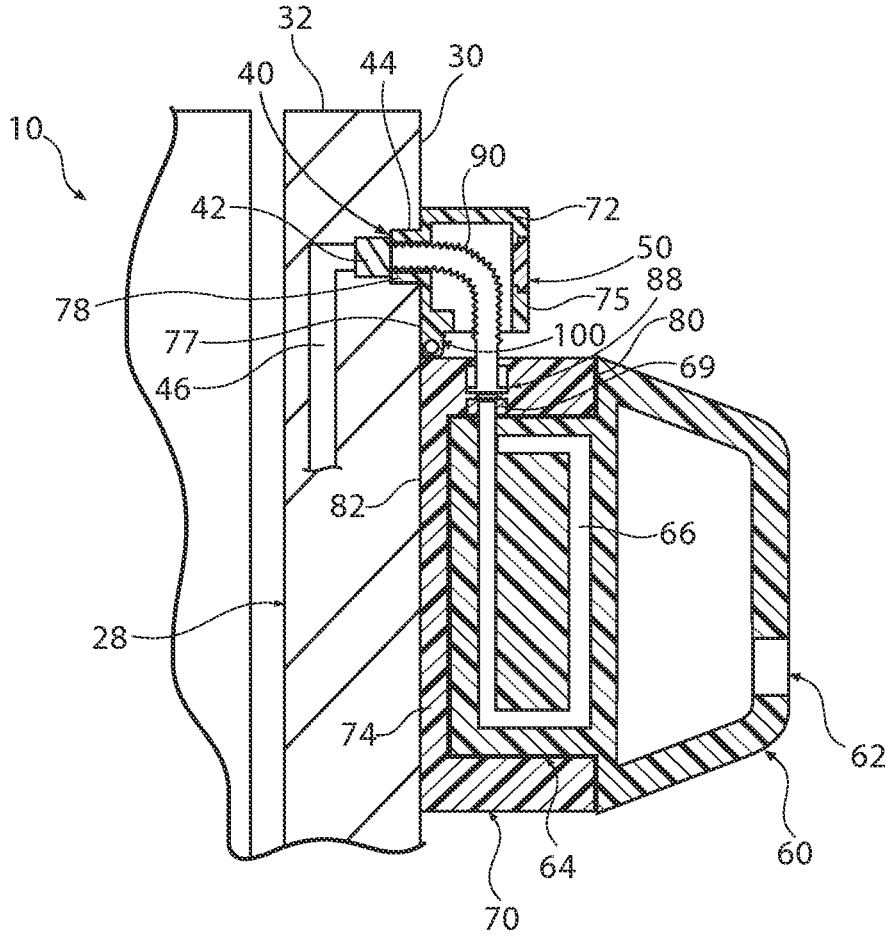
FIG. 7 is a partial side cross-sectional view of the modular system of FIG. 1 showing the adapter coupled to the host substance communication interface on the host and the functional device and the interface cover coupled to the adapter.

It will be appreciated that adapter 70 may be designed so as to be generally flush with the exterior of host 20. Thus, when used with host 20 having host substance communication service interface 40 extending inwardly from a vertical surface, such as vertical front face 30, as illustrated in FIGS. 6-7, adapter 70 may be configured such that both members 72 and 74 are disposed vertically against and flush with the vertical front face 30. Similarly, both members 72 and 74 of adapter 70 can be mounted flush with a horizontal surface or an angled surface (not shown).

It follows that members 72 and 74 may be rotated relative to one another via hinge system 100 so as to be oriented at any angle relative to one another, as required for mounting the adapter 70 to a particular host in a desirable manner. It may further be desirable to releasably lock members 72 and 74 of adapter 70 into one or more of these relative orientations to prevent undesirable movement or swinging of either member 72, 74 of the adapter 70, particularly if the adapter 70 is to be mounted to a moving host, such as a vehicle, or to a moving component of a host, such as a door. Such a lock can be incorporated into the hinge system 100, as will be described in more detail hereinafter.

Figure 15:
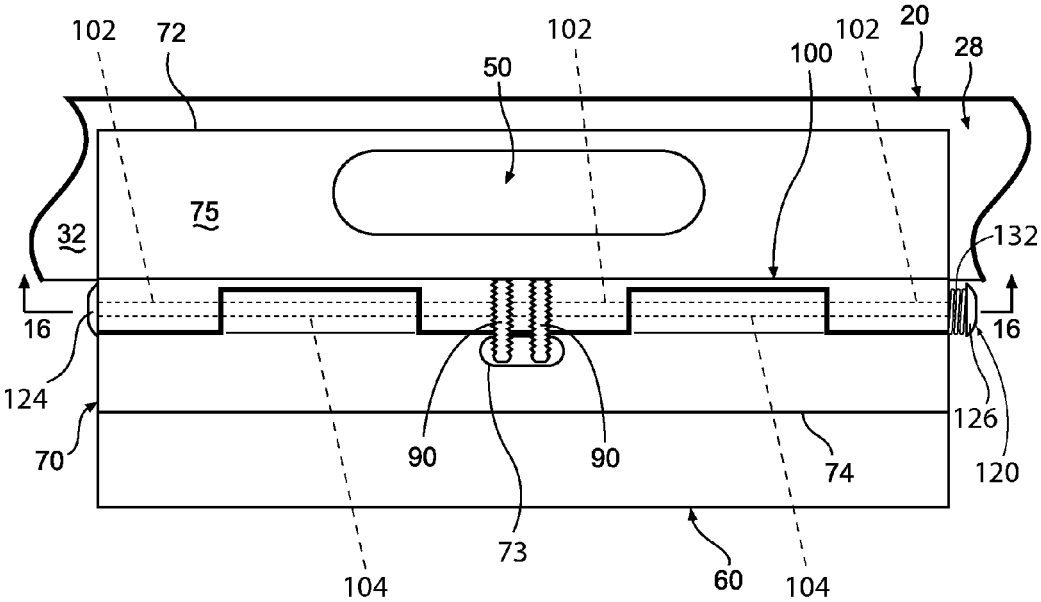
FIG. 15 is a partial top plan view of the modular system of FIG. 9, with portions shown in phantom, showing the adapter coupled to the host substance communication interface on the host and the functional device and the interface cover coupled to the adapter.
Figure 16:
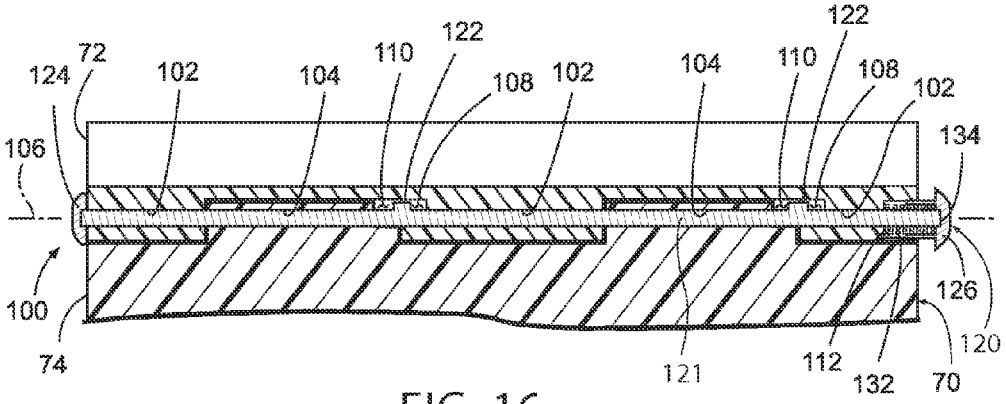
FIG. 16 is a partial cross-sectional view of the adapter of FIG. 9 taken along line 16 of FIG. 15, with portions shown schematically and in phantom, showing the adapter decoupled from the host and having a hinge system illustrated in a locked position.
Figure 17:
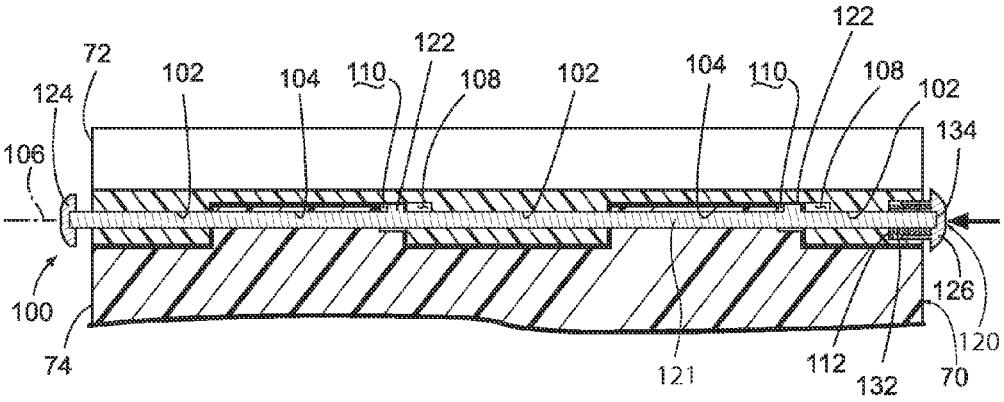
FIG. 17 is a partial cross-sectional view of the adapter similar to FIG. 16 and showing the hinge system of the adapter in an unlocked position.

Referring to FIGS. 15-17, the hinge system 100 may include two or more aligned passageways 102 and 104 formed within member 72 and in member 74, respectively. The passageways 102, 104 are illustrated as generally cylindrical in shape but can alternatively have any shape suitable for the purposes described herein. Passageways 102 and 104 together define a pivot axis 106 of hinge system 100 about which the member 72 and member 74 can pivot relative to one another. As illustrated, the hinge system 100 comprises three passageways 102 in member 72 and two passageways 104 in member 74. The passageways 102, 104 are configured for coaxial alignment when the members 72, 74 are mounted to one another by the hinge assembly 100. One of the passageways 102 is provided with at least one keying feature, such as keyways 108, at a position adjacent one of the passageways 104, which is provided with a corresponding keying feature(s), such as keyways 110. At least one of the passageways 102, 104 is provided with an enlarged portion or counter bore, such as counter bore 112 in one of the passageways 102.

A hinge pin 120 comprises an elongated body 121 having at least one key 122 configured for selective engagement with one or both of the keyways 108 110. The hinge pin 120 is disposed substantially within passageways 102 and 104. Key 122 and keyways 108, 110 form a releasable lock for selectively interlocking hinge pin 120 and members 72 and 74 in one or more predetermined positions or relative orientations as described previously herein.

A head 124 is provided on one end of hinge pin 120. The other end of hinge pin 120 is attached to an end cap 126 that is reciprocally disposed in the counter bore 112. End cap 126 may include a coil spring 132. Hinge pin 120 passes through passageways 102 and 104, counter bore 112, and coil spring 132, and is attached to end cap 126, for example, by engaging an end of hinge pin 120 with an aperture 134 in end cap 126.

In operation, coil spring 132 biases hinge pin 120 into a locked position, shown in FIG. 16, wherein key 122 is engaged in both keyways 108 and 110 so as to prevent rotation of members 72 and 74 relative to one another. Member 72 may be pivoted relative to member 74 by disengaging key 122 from keyway 108. This can be accomplished by applying an inward force (designated by the arrow in FIG. 17) to the end cap 126, such as by a user pressing a finger against the end cap 126, to slide hinge pin 120 axially within passageways 102 and 104, which causes the key 122 to disengage from keyway 108, as shown in FIG. 17. The user can then rotate the members 72, 74 into a desired orientation. Upon releasing end cap 126, hinge pin 120 is urged back to its locked position by the coil spring 132, wherein key 122 engages both keyways 108, 110. The keyways 108, 110 can be configured so as to lock the members 72, 74 into one or more specific orientations as desired.

The hinge system 100 can be configured to permit the substance lines 90 to pass between the members 72, 74 without interruption. Further, the substance lines 90 can be configured to permit the flow of substance therethrough regardless of the orientation of the members 72, 74. For example, the substance lines 90 can be somewhat flexible or elastic to permit movement of the hinge system 100 to place the members 72, 74 in different positions or orientations. Substance lines 90 may further be routed between members 72 and 74 through a reinforced or fortified section 73 adjacent hinge system 100 to prevent or reduce wear of the substance lines 90 caused by movement of the hinge system 100.

Hinge system 100 may alternately use multiple separate pins to join the members 72, 74. Alternatively, a locking system independent of hinge system 100 may releasably secure member 72 in either or both of the horizontal and vertical orientations relative to member 74.

Figure 9:
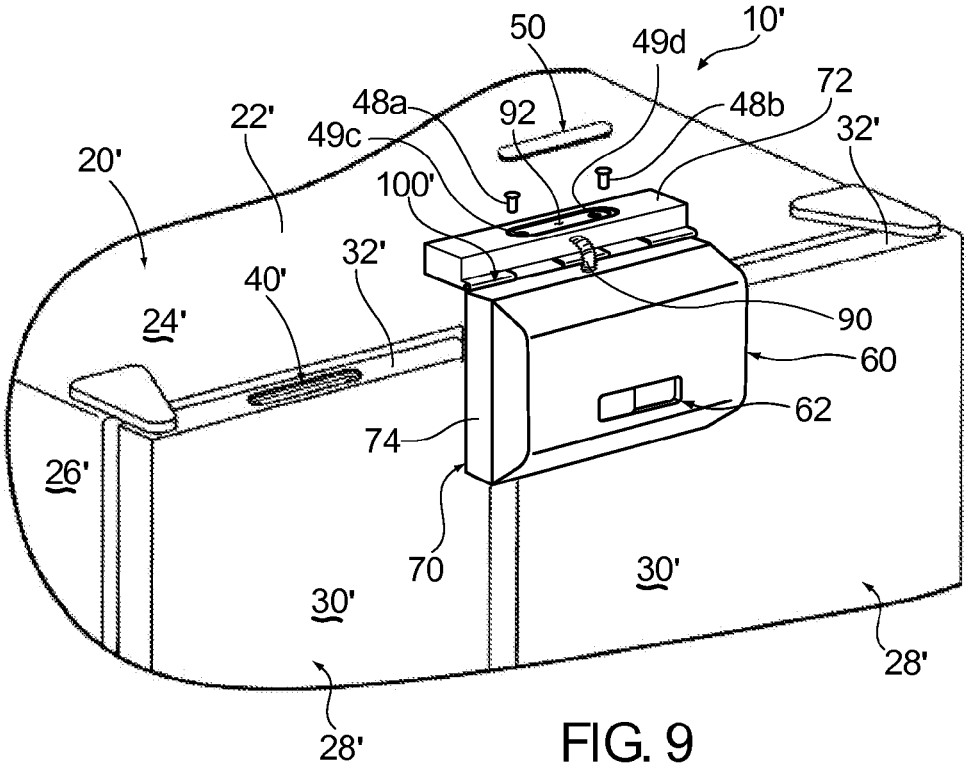
FIG. 9 is a partial front perspective view of a modular system according to a second embodiment of the invention similar to the modular system of FIG. 1 and employing the adapter of FIG. 8 for coupling the functional device to the host, and further employing the interface cover for coupling to the adapter or to a differently-oriented host substance communication interface on the host.
Figure 10:
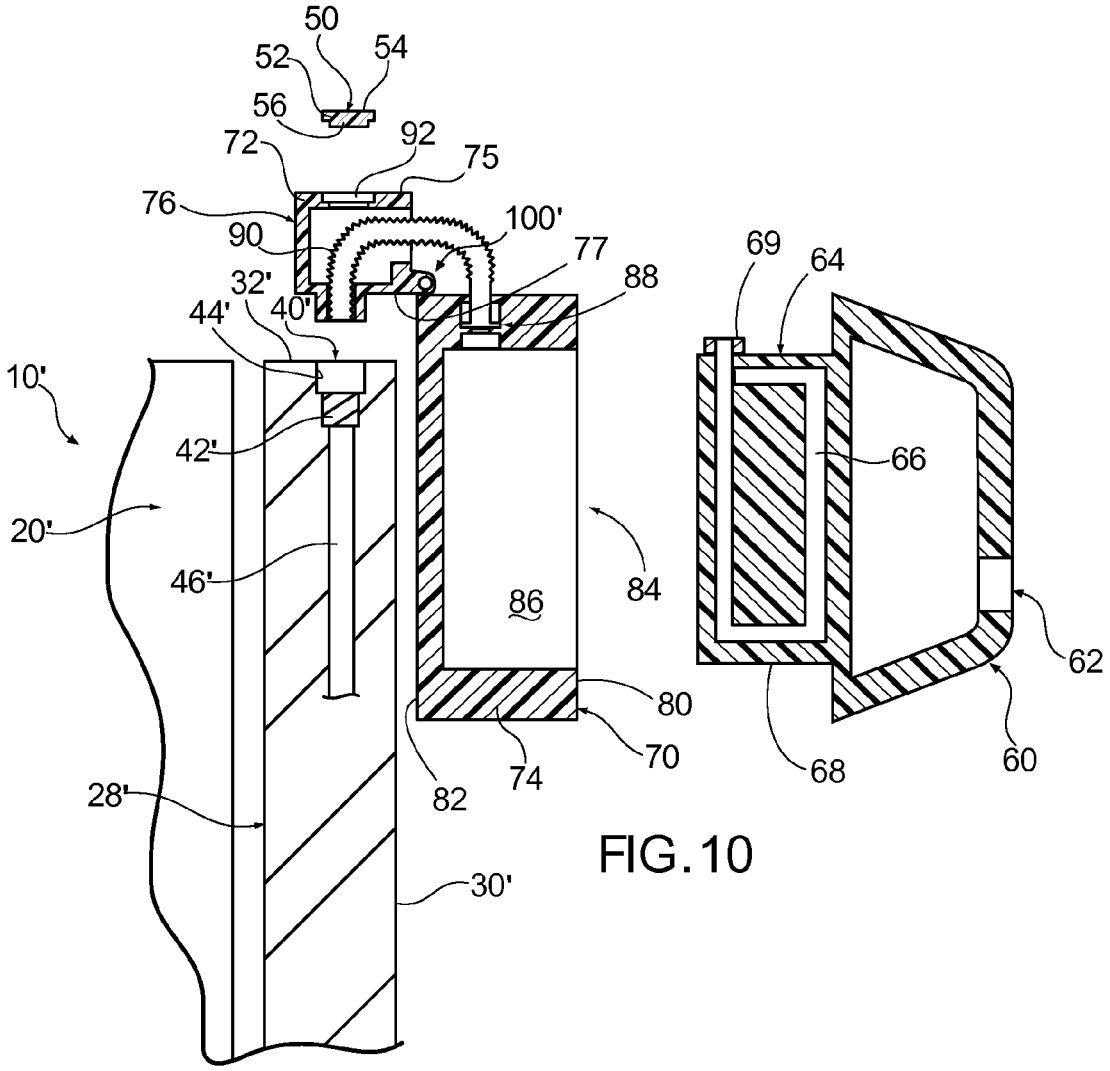
FIG. 10 is a partial side cross-sectional view through the modular system of FIG. 9 showing the adapter, the functional device, and the interface cover decoupled from the host and from one another.
Figure 11:
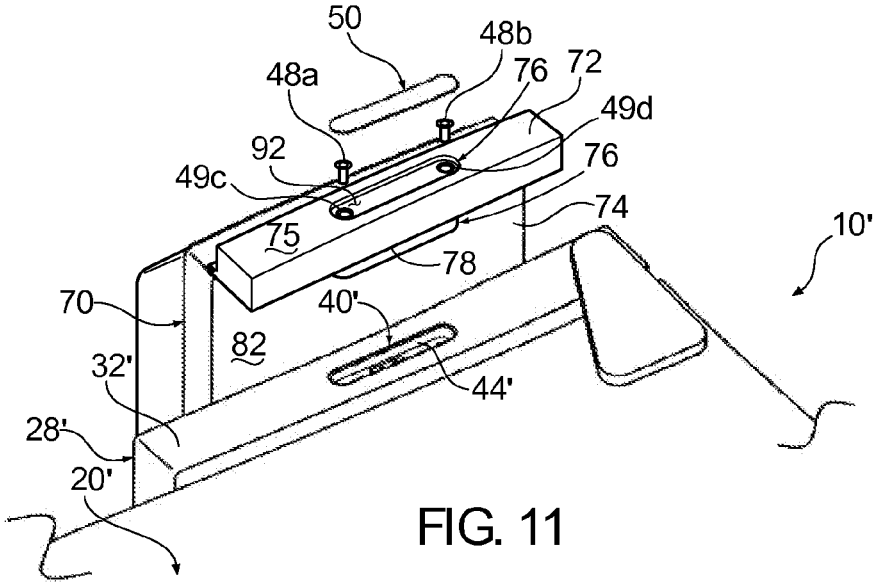
FIG. 11 is a partial top rear perspective view of the modular system of FIG. 9 showing the showing the adapter, the functional device, and the interface cover decoupled from the host and from one another.

Hinge system 100 permits relative movement of the members 72, 74 to place them in different orientations having different angular relationships between the members 72, 74. For example, in one angular relationship, the members 72, 74 are generally oriented along a common plane, such as can be seen in FIG. 6. In another angular relationship, the members 72, 74 are generally oriented along perpendicular planes, such as can be seen in FIGS. 9 and 18. The two angular relationships are approximately 90° apart from the other. Angular relationship between the members 72, 74 other than those illustrated herein are also possible.

Referring to FIGS. 9-15, a second embodiment of a modular system 10' according to the invention is illustrated. The second embodiment modular system 10' similar in some respects to the first embodiment, and like elements will be identified using the same reference numerals. For the second embodiment, the host substance communication service interface 40' has a different orientation, but is otherwise substantially similar to the host substance communication service interface 40 shown in FIGS. 1-7. The host substance communication service interface 40' is illustrated on a horizontal top edge 32' of one of the doors 28'. The host substance communication service interface 40' can be considered to be "upwardly-opening" since the recess 44" is open in an upward direction. The adapter 70 may be configured such that upper member 72 is flush with the horizontal top edge 32' of host 20' while the lower member 74 is flush with the vertical front face 30' of the host 20'. In this position, the adapter 70 is still carried by the door 28'. The hinge system 100 permits the members 72, 74 to rotate relative to each other as required for coupling with host substance communication service interface 40'. As illustrated, the upper and lower members 72, 74 are orientated at approximately 90° to each other.

Figure 12:
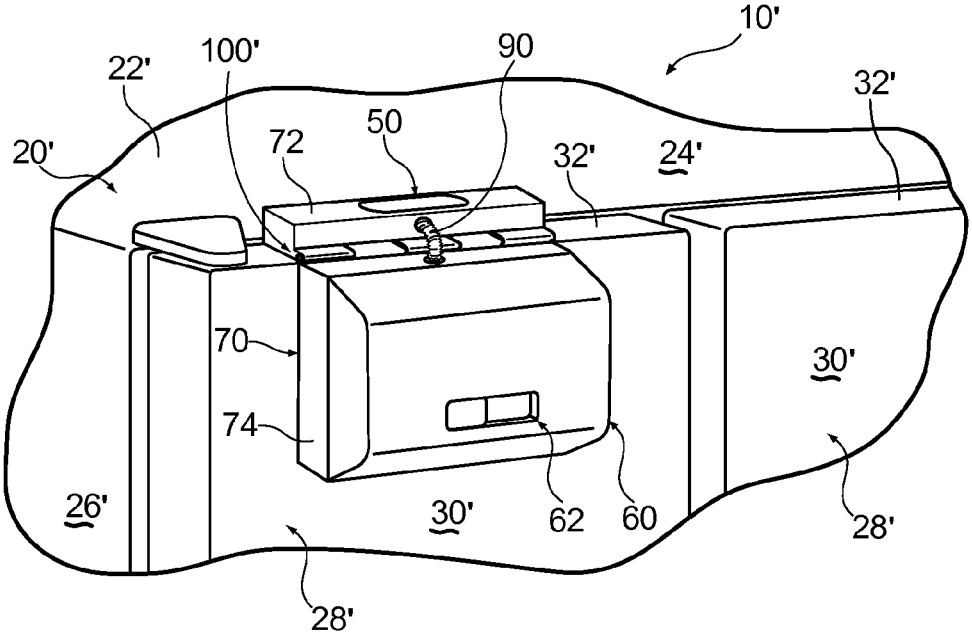
FIG. 12 is a partial front perspective view of the modular system of FIG. 9 showing the adapter coupled to the host substance communication interface on the host and the functional device and the interface cover coupled to the adapter.
Figure 13:
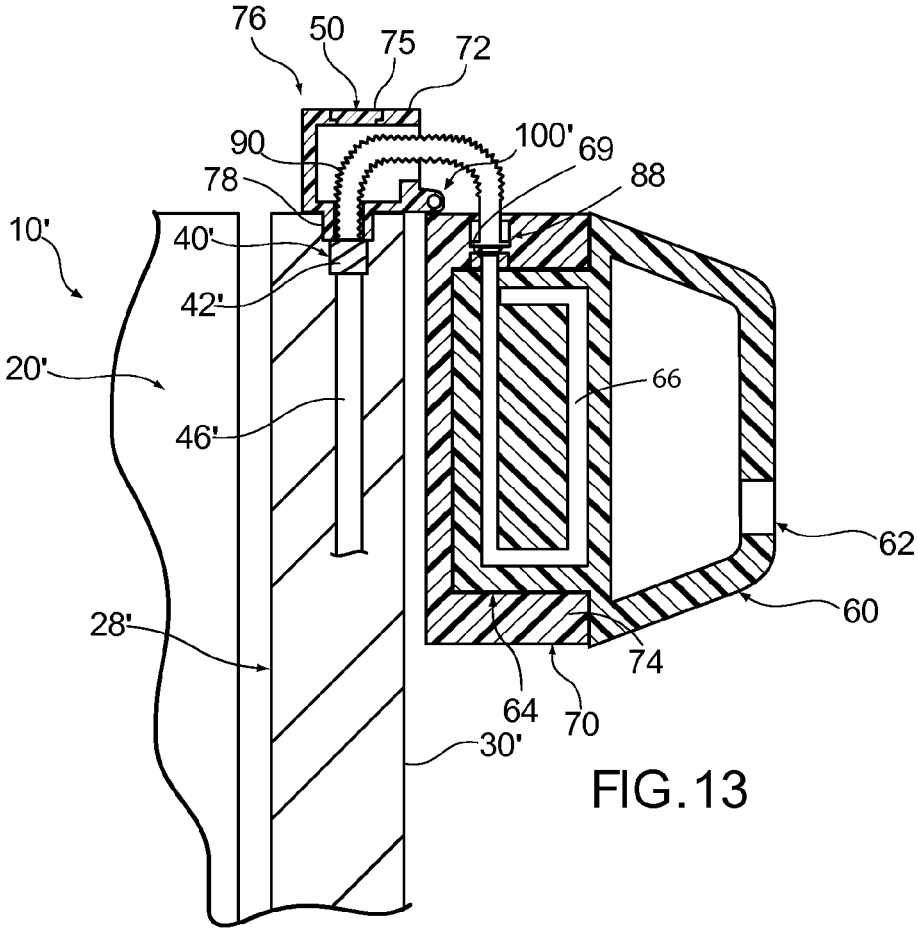
FIG. 13 is a partial side cross-sectional view of the modular system of FIG. 9 showing the adapter coupled to the host substance communication interface on the host and the functional device and the interface cover coupled to the adapter.
Figure 14:
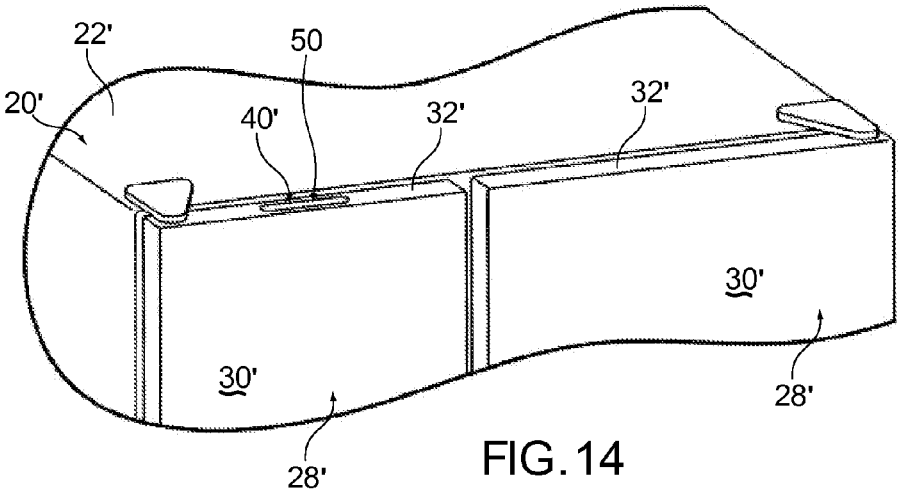
FIG. 14 is a partial front perspective view of the modular system of FIG. 9 showing the interface cover coupled to the host substance communication interface of the host.

Referring to FIGS. 12 and 14, the interface cover 50 can alternately be mounted to the adapter 70 to cover the recess 92, as shown in FIG. 12, or to the host 20' when the adapter 70 is not present, as shown in FIG. 14.

Figure 8:
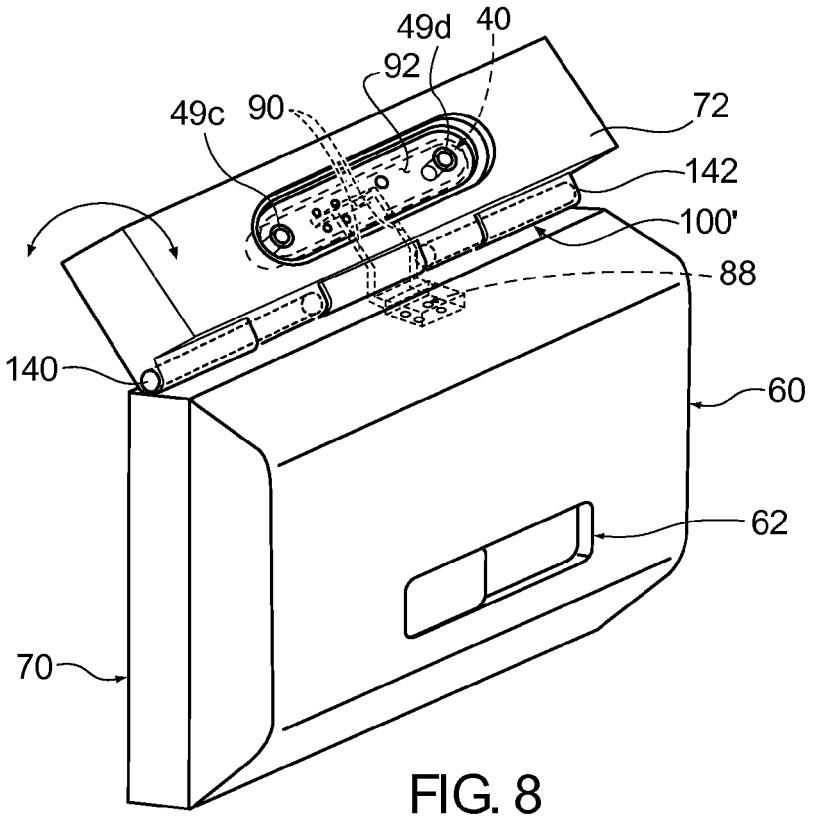
FIG. 8 is a perspective view of a first alternative adapter suitable for use with any of the modular systems of FIGS. 1-7, FIGS. 9-14, and FIG. 18 showing the first alternative adapter decoupled from the host and utilizing a dual-pin hinge system, and also showing the functional device coupled to the adapter.

Referring to FIG. 8-9, the adapter 70 of the second embodiment comprises a modified hinge system 100'. The hinge system 100' of the second embodiment is substantially similar to the hinge system described for FIGS. 16-17, except that the illustrated hinge system 100' uses two separate pins 140 and 142, each passing through at least two passageways and partially into the third (not shown). A gap between pins 140 and 142 is provided for lines 90 to be routed between members 72 and 74 across the pivot axis of hinge system 100'. Service lines for an additional service, such as electrical power or data, may also be routed through the gap. At least one and optionally both of pins 140 and 142 can be provided with keying features for use with a corresponding keyway feature as described above. Alternatively (not shown) hinge system 100' may have a single pin extending substantially along the entire length of the adjoining edges of members 72 and 74 and substance communication service lines 90 may be routed on one side or the other side of hinge system 100'. This provides a simpler structure for hinge system 100', particularly if service lines 90 are relatively small and flexible.

Referring to FIGS. 18-19, a third embodiment of a modular system 10" according to the invention is illustrated. The third embodiment modular system 10" is similar in some respects to the first and second embodiments, and like elements will be identified using the same reference numerals. As described above, host substance communication service interface 40" may be associated with a host 20" other than an appliance. For the third embodiment, the host 20" may be mounted to a wall 144. While illustrated schematically as projecting from wall 144 and providing an upwardly oriented host substance communication service interface 40", host 20" may alternatively be oriented in any desired direction. Host 20" may be integrated with wall 144 to provide a flush mounting with wall 144 or may be a modular unit that may be removably mounted to wall 144. Host 20" may have its own internal supplier or consumer of the substance or may receive the substance from the environment such as by being coupled to a residential water supply. The same mechanical connectors, such as screws 48*a*, 48*b*, could be located on either side of the coupler to couple adapter 70 to host 40".

The adapter 70 may be provided with a collapsible covering 150 aesthetically hiding and restricting inadvertent access to the portions of substance line 90 extending between members 72 and 74 of adapter 70. Collapsible covering 150 may be a flexible plastic panel, a tambour door, or a series of nested panels that extend or contract as the members 72 and 74 are pivoted relative to each other.

Although each of the modular systems 10, 10', 10" is described as having a single host, a single host electromagnetic service interface, a single adapter, and a single functional device, various additional combinations of these components can also be considered to be modular systems. As non-limiting examples, an adapter plus any two similar host electromagnetic service interfaces as well as an adapter plus two dissimilar hosts each with a host electromagnetic service interface can also be considered modular systems when the adapter may be alternatively coupled to either of the host electromagnetic service interfaces.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In summary, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A system for communicating a substance, comprising:

a host having a host substance communication service interface that provides a mechanical support service and communicated a substance, the host substance communication service interface having one of a vertical orientation or a horizontal orientation;

a substance communicating device comprising a first member having a device substance communication service interface that removably couples with the host substance communication service interface, and when coupled, receives the mechanical service and communicates the substance to or from host substance communication service interface; and a second member capable of supporting a functional device;

wherein the first member is pivotally connected to the second member to move between at least a first position where the device substance communication service interface is coupled to the host substance communication service interface having the vertical orientation, and a second position where the device substance communication service interface is coupled to the host substance communication service interface having the horizontal orientation; and wherein when the first member is in the first position the first and second members are oriented along a common plane and when the first member is in the second position the first and second members are oriented along perpendicular planes;

wherein the second member will maintain the same orientation relative to the host regardless of whether the first member is in the first position or the second position;

wherein the device substance communication service interface comprises a device substance line which comprises a flexible conduit for transferring the substance which permits the movement of the first member between the first and second positions;

wherein the host substance communication service interface comprises a host substance line which comprises a conduit for transferring the substance; and wherein the substance is at least one of a gas, a liquid, or a solid.

2. The system according to claim 1 wherein the second member comprises a functional device substance communication service interface that is capable of providing a mechanical support service and communicating the substance to or from the functional device.

3. The system according to claim 1, and further comprising at least one releasable lock securing the first member in at least one of the first and second positions.

4. The system according to claim 1, and further comprising a removable cover mounted to the host to cover the host substance communication service interface when the substance communicating device is not coupled with the host, and mounted to the substance communicating device when the substance communicating device is coupled with the host.

5. The system according to claim 4 wherein the removable cover is mounted to the first member when the substance communicating device is coupled with the host.

6. The system according to claim 1, wherein the substance communicating device provides at least one service different from the mechanical support service capable of being provided by the host.

7. The system according to claim 1 wherein the host substance communication service interface is integral with the host.

8. The system according to claim 1 wherein the host comprises a door with a peripheral edge, and the host substance communication service interface has a horizontal orientation, and is provided on the peripheral edge.

9. The system according to claim 1 wherein the host comprises a door with a vertical face, and the host substance communication service interface has a vertical orientation, and is provided on the vertical face.

10. The system according to claim 1 wherein the host comprises a wall.

11. The system according to claim 1 wherein the host substance communication service interface has a vertical orientation, and wherein the host comprises a vertical surface and the host substance communication service interface is provided on the vertical surface.

12. The system according to claim 11 wherein the host substance communication service interface comprises a recess extending inwardly from the vertical surface.

13. The system according to claim 1 wherein the host substance communication service interface has a horizontal orientation, and wherein the host comprises a horizontal surface and the host substance communication service interface is provided on the horizontal surface.

14. The system according to claim 13 wherein the host substance communication service interface comprises a recess opening upwardly from the horizontal surface.

* * * * *